United States Patent [19]

Blier

[11] 4,371,057

[45] Feb. 1, 1983

[54] TELESCOPIC SCAFFOLD

[75] Inventor: Daniel Blier, Riviere-du-Loup, Canada

[73] Assignee: 100426 Canada Ltée., Quebec, Canada

[21] Appl. No.: 217,186

[22] Filed: Dec. 16, 1980

[51] Int. Cl.[3] ..... E04G 1/14; E04G 1/18

[52] U.S. Cl. ..... 182/184; 182/179; 182/183; 182/201; 52/638

[58] Field of Search ..... 182/179, 183, 184, 185, 182/224, 178, 201; 52/638

[56] References Cited

U.S. PATENT DOCUMENTS

| | | | |
|---|---|---|---|
| 437,935 | 10/1890 | O'Brien | 182/179 |
| 1,060,914 | 5/1913 | Lillow | 182/179 |
| 1,832,537 | 11/1931 | Erwin | 182/179 |
| 2,410,330 | 10/1946 | Ashenfelter | 182/184 |
| 2,599,670 | 6/1952 | Thomas | 182/179 |
| 2,751,258 | 6/1956 | Brattland | 182/179 |
| 3,564,802 | 10/1969 | Dreyfus | 182/179 |

*Primary Examiner*—Reinaldo P. Machado
*Attorney, Agent, or Firm*—Oblon, Fisher, Spivak, McClelland & Maier

[57] ABSTRACT

A telescopic scaffold comprising opposed pairs of elongated support legs each received in adjustable sleeve members securable at a predetermined location therealong. Arresting means is provided to interlock each sleeve member with its associated leg at a predetermined location therealong. An adjustable bracing end support structure is adjustably securable between each adjustable sleeve member of each pair of legs to secure each leg of the pairs of legs at a desired inclined angle to each other and at a desired spacing therebetween. A tubular support member is secured to each of the adjustable sleeve members and extends transverse to the longitudinal axis of the sleeve member and the end bracing. An intermediate horizontal support member is telescopically securable between opposed tubular members of the opposed pairs of support legs to constitute adjustable elongated side supports.

9 Claims, 4 Drawing Figures

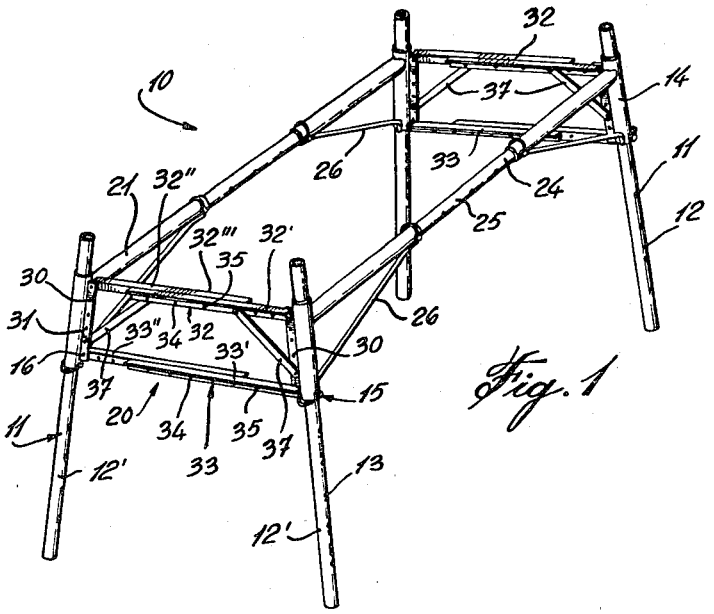
Fig. 1
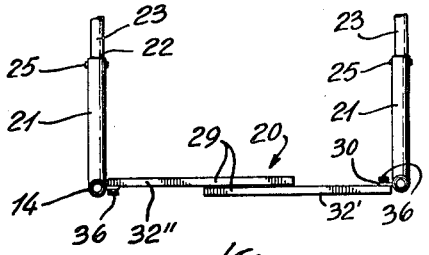
Fig. 3
Fig. 4
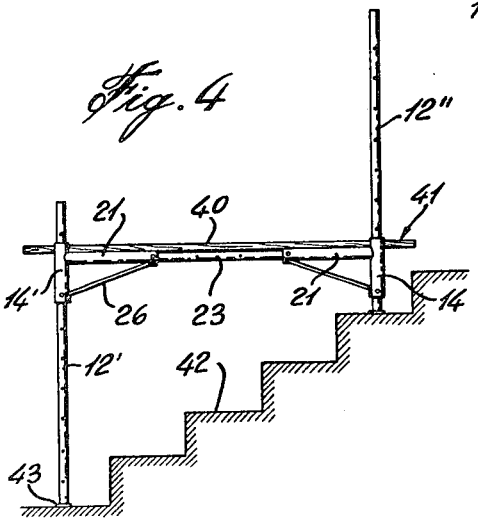
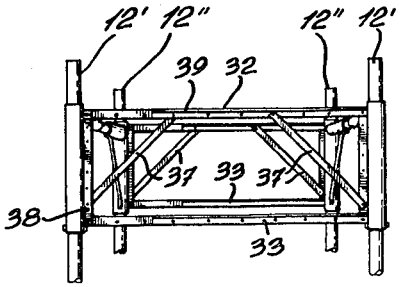
Fig. 2

TELESCOPIC SCAFFOLD

BACKGROUND OF INVENTION (a) Field of the Invention

The present invention relates to a telescopic scaffold wherein end and side supports are adjustable in length and in height and wherein end pairs of support legs are adjustable at inclined angles with respect to one another and are received in an adjustable sleeve securable at a predetermined distance therealong to vary the length of each of opposed pairs of support legs.

(b) Description of Prior Art

Various types of telescopic scaffolds having adjustable legs and horizontal end and side supports are known. However, there is a need to provide a telescopic scaffold wherein all of these features are provided in addition to providing an adjustable bracing end support whereby each support leg of a pair of legs may be rigidly secured close together or at an inclined angle with respect to a vertical axis and wherein each pair of support legs may be adjusted with respect to a support frame whereby the scaffold may be used on an irregular surface whilst maintaining a support platform substantially horizontal. There also exists the need to provide such telescopic scaffold with the added features of being lightweight and easily erectable and dismanteable and which is further constructed of parts which are easily transportable and easily storable in a small package.

SUMMARY OF INVENTION

It is a feature of the present invention to provide a telescopic scaffold which provides all of the above-mentioned needs.

A further feature of the present invention is to provide a telescopic scaffold which is easy to assemble and disassemble, easy to transport, economical to produce, and wherein each constituent part thereof is relatively small to provide a compact package.

Another feature of the present invention is to provide a telescopic scaffold wherein the support platform, horizontal end and side supports are adjustable in length and wherein opposed pairs of support legs are also adjustable in support height and wherein they may be adjustably held at a desired inclined angle with respect to a vertical axis.

According to the above features, from a broad aspect, the present invention provides a telescopic scaffold comprising opposed pairs of elongated support legs each received in adjustable sleeve members securable at a predetermined location therealong. Arresting means is provided to interlock each sleeve member with its associated leg at a predetermined location therealong. An adjustable bracing end support structure is adjustably securable between each adjustable sleeve member of each pair of legs to secure each leg of the pairs of legs at a desired inclined angle to each other and at a desired spacing therebetween. A tubular support member is secured to each of the adjustable sleeve members and extends transverse to the longitudinal axis of the sleeve member and the end bracing. An intermediate horizontal support member is telescopically securable between opposed tubular members of the opposed pairs of support legs to constitute adjustable elongated side supports. A vertical flange is secured along each sleeve of the pairs of sleeves and a plurality of spaced apart holes are provided in each flange. The adjustable bracing end support structure comprises a top and bottom transverse adjustable support member secured in a spaced apart relationship across opposed legs of each pair of legs and secured at their respective ends to the flanges of the pair of sleeves. Adjustably securable brace members are secured adjacent an end thereof to a selected one of the holes in an associated one of the vertical flanges of one of the pairs of sleeves and extending angularly toward the top transverse support members and having its other end secured thereto to provide a rigid top transverse support. The adjustable transverse supports have their lengths adjustably secured whereby to vary the inclined angle of each of the sleeve and the legs.

BRIEF DESCRIPTION OF DRAWINGS

A preferred embodiment of the present invention will now be described with reference to the accompanying drawings in which:

FIG. 1 is a perspective view of the telescopic scaffold of the present invention;

FIG. 2 is an enlarged fragmented detail perspective view of a corner of the scaffold;

FIG. 3 is a top view showing the interconnection between support legs of each pair of support legs; and FIG. 4 illustrates the telescopic scaffold in use and supported on an irregular surface.

DESCRIPTION OF PREFERRED EMBODIMENTS

Referring now to the drawings, and more particularly to FIGS. 1 to 3, there is shown generally at 10, the telescopic scaffold of the present invention and comprising opposed pairs of elongated support legs 11 each comprising two elongated tubular steel support legs 12 having a plurality of spaced-apart holes 13 diametrically disposed thereacross. An adjustable sleeve member 14 is slidingly received over a respective one of the support legs 12 and securable therealong at a predetermined location. Each sleeve member is provided with arresting means 15 which is constituted by diametrically disposed holes in the tubular side wall thereof and receiving a lock bolt 16 therethrough and through one of the holes 13 in its associated support leg 12 whereby to lock the sleeve 14 onto the support legs 12. As shown in FIG. 2, each lock bolt 16 is provided with a wire 17 secured to the head 18 thereof and having a retaining pin 19 attached to the free end of the wire 17. The retaining pin 19 is disposed through a transverse hole (not shown) adjacent the free end of the lock bolt 16 whereby to prevent the lock bolt 16 from sliding out of its connection across the sleeve member 14 and the support legs 12.

An adjustable bracing end support structure 20 is adjustably securable between each adjustable sleeve member 14 of each pair of legs, such as the pair of legs 12'. The support structure 20 permits the pairs of legs 12' to be secured vertically or at a desired inclined angle with respect to a vertical axis and at a desired spacing therebetween. Each leg is adjustable within an angle of about 15°.

A tubular support member 21 is secured to each of the adjustable sleeve members 14 and extends transverse to the longitudinal axis of the adjustable sleeve member and the end bracing 20, as can be seen in FIG. 3. An angular brace member 26, herein a steel rod, solidifies the connection between the members 14 and 21. The tubular support member 21 is a hollow cylindrical steel tube having diametrically opposed holes adjacent a free end 22 thereof whereby to receive an intermediate horizontal support member 23 therein and telescopically displaceable therewith whereby to adjust the length of the elongated side supports 24. These elongated side supports 24 are also provided with a plurality of spaced apart holes extending diametrically across the member 23 whereby a lock bolt 25 may secure the intermediate horizontal support members 23 in their respective tubular support members 21 at a desired location therein whereby to vary the total length of the elongated side supports 24.

As shown in the drawings, each of the adjustable sleeve members 14 have a vertical flange 30 secured therealong with each flange being provided with a plurality of spaced apart holes 31 therealong. The adjustable bracing end support structure comprises a top and bottom transverse support member 32 and 33 secured in spaced apart relationship across opposed legs of each pair of legs 12' and secured at their respective ends to selected ones of the holes 31 provided in the flanges 30. Preferably, the top support member 32 is secured to the uppermost ones of the holes 31 and the bottom support member 33 to the lowermost ones of the holes 31.

The top and bottom transverse support members 32 and 33 are each comprised of two elongated bars 32' and 32'' for member 32 and 33' and 33'' for member 33, which are interconnectable together adjacent their free ends by securable means, such as fasteners 34 extending through aligned ones of a plurality of holes 35 spaced apart along each bar 32', 32'', 33' and 33''. Thus, the length of the support members 32 and 33 may be varied whereby to space the support legs 12' closer or farther from one another and at a desired inclined angle, if required. The free ends of the support members 32 are secured to their respective sleeves 30 by fasteners 36.

As shown in FIG. 1, the support legs 12', are inclined towards one another from their top end with their bottom ends being further spaced apart for better stability. The brace member 37 adds rigidity to the top member 32 on which a support platform is positioned and also solidifies the end bracing to maintain the legs rigidly in position. These members 37 are elongated flat steel bars having holes adjacent respective ends thereof whereby an end of the member 37 is secured to a desired one of the holes 31 in its associated flange 30 by the fastener 38 and the upper end is secured to a desired one of the holes 35 of the transverse support member 32. This is illustrated by fastener 39 and it is also pointed out that the fastener 39 may also be used to interconnect overlapped end portions 32''' of the transverse support members 32' and 32'' should the support legs 12' be secured closer together, such as when the scaffold is used in a narrow space.

As shown more clearly in FIG. 3, each of the elongated bars, such as 32' and 32'', are right angle flat bars with the holes 35 being provided in the vertical wall portion of the flat bars while the horizontal top portion is disposed uppermost to constitute a flat support surface 29 for supporting boards 40 positioned thereon to constitute a support platform 41.

This support surface 29 formed by overlapping right angle bars, such as 32' and 32'', in combination with the brace members 37 provide a rigid narrow support surface across each support leg 12 of a pair of legs 12'.

FIG. 4 shows the versatility of the scaffold of the present invention as used on an irregular surface such as a staircase 42. Because of the features of the end support structure 20 as above-described, the support legs 12 may be held close together to permit the erection of the scaffold in the narrow width of a staircase. Additionally, the adjustable feature of the sleeve members 14 permits one pair of sleeves 14' to be adjusted near a top end of the pair of legs 12' whilst the sleeves 14'' of the other pair of legs 12'' are secured adjacent the lower end of the legs 12''. Furthermore, the spacing between the sleeves 14' and 14'' is adjustable by means of the tubular support members 21 and the intermediate horizontal support member 23 whereby the lower end of the tubes 12' and 12'' may be located safely on a respective thread member of the staircase 42. The lower ends of the support legs 12 may also be provided with flat shoes 43 to provide better support of the scaffold when used on flat surfaces and to prevent damage to the support surface. After the sleeves 14' and 14'' are secured to their respective support legs, boards 40 may be positioned across the transverse support members 32 to constitute the substantially horizontal support platform 41.

As hereinshown, all of the elements of the telescopic scaffold structure are constructed of steel. The support legs 12, the sleeves 14 and the tubular support members 21 are hollow cylindrical pipes of circular cross section of the type utilized for automobile muffler conduits and having a diameter of 2 and $2\frac{1}{4}''$. A particular scaffold was constructed having the following specification and weighed 48 kl. It was capable of supporting a weight of up to 455 kl and the cost of constructing the scaffold was minimal.

| | SPECIFICATION | | |
|---|---|---|---|
| | MIN. | MAX. | VARIATION |
| Length | 165 cm | 280 cm | 115 cm |
| Width | 75 cm | 115 cm | 40 cm |
| Height | 40 cm | 155 cm | 115 cm |

It is within the ambit of the present invention to provide any obvious modifications of the abovedescribed example of a preferred embodiment, provided such modifications fall within the scope of the appended claims.

I claim:

1. A telescopic scaffold comprising opposed pairs of elongated support legs, each said legs being received in an adjustable sleeve member securable at a predetermined location therealong, arresting means to interlock said sleeve member with its associated leg at said predetermined location, an adjustable bracing end support structure adjustably securable between each said adjustable sleeve members of each pair of said legs to secure each leg of said pairs of legs vertically or at a desired inclined angle to each other and at a desired spacing therebetween, a tubular support member secured to each said adjustable sleeve members and extending transverse to the longitudinal axis of said adjustable sleeve member and said end bracing, an intermediate horizontal support member telescopically securable between opposed tubular members of said opposed support legs to constitute adjustable elongated side supports, a vertical flange secured along each sleeve of said pairs of sleeves, a plurality of spaced apart holes in each flange, said adjustable bracing end support structure comprising a top and bottom transverse adjustable support member secured in a spaced apart relationship across opposed legs of each pair of legs and secured at their respective ends to said flanges of said pair of sleeves, adjustably securable brace members secured adjacent an end thereof to a selected one of said holes in an associated one of said vertical flanges of one of said pairs of sleeves and extending angularly toward said top transverse support members and having its other end secured thereto to provide a rigid top transverse support, said adjustable transverse supports having their lengths adjustably secured whereby to vary said inclined angle of each said sleeves and said legs.

2. A telescopic scaffold as claimed in claim 1 wherein said top and bottom transverse support members are each comprised of two elongated bars interconnectible together adjacent their free ends by securable means, said elongated bars having a plurality of holes therealong for selected interconnection of said bars whereby the length of said bars may be adjustably secured.

3. A telescopic scaffold as claimed in claim 3 wherein said elongated bars are flat bars of right angle cross section, said holes in said bars being spaced apart holes in a vertical wall portion of said flat bars.

4. A telescopic scaffold as claimed in claim 4 wherein said securable means is constituted by one or more lock bolt fasteners extending through aligned ones of said holes in overlapped end portions of said two flat bars.

5. A telescopic scaffold as claimed in claim 5 wherein a fastener also secures said one end of a respective brace member to said support member, said flat bars having a horizontal wall portion disposed uppermost to constitute a flat support surface for supporting boards disposed thereon to form a support platform.

6. A telescopic scaffold as claimed in claim 1 wherein said support legs, adjustable sleeves and support members are tubular hollow steel pipes of circular cross section; said arresting means being a steel securement pin removably insertable in diametrically aligned holes in said support legs and sleeves, two of said support members of opposed pairs of support legs being secured to a common one of said intermediate connecting support member by steel securement pins disposed in diametrically aligned holes in an end of each said support members and a selected one of a plurality of holes in said intermediate member depending on the desired length of said side supports.

7. A telescopic scaffold as claimed in claim 6 wherein an angular brace member is secured adjacent opposed ends thereof near a free end of each said tubular support members and a lower end of its associated adjustable sleeve member.

8. A telescopic scaffold as claimed in claim 1 wherein each said adjustable sleeve members of each pair of support legs are idependently securable at a desired position along said pairs of legs and disposed in close sliding fit over its respective leg.

9. A telescopic scaffold as claimed in claim 1 wherein each said support legs is adjustably securable by said adjustable bracing end support structure at a desired angle from a vertical axis to about a 15° angle with a top portion of said legs of each pair of legs being inclined closer together.

* * * * *